United States Patent [19]

Zapp

[11] 4,077,295

[45] Mar. 7, 1978

[54] FINE TUNING PEG

[76] Inventor: Walter Zapp, Ebenau 877, Oberegg, Switzerland, 9413

[21] Appl. No.: 717,513

[22] Filed: Aug. 25, 1976

[30] Foreign Application Priority Data

Aug. 29, 1975 Switzerland ..... 11375/75

[51] Int. Cl.[2] ..... G10D 3/14

[52] U.S. Cl. ..... 84/304

[58] Field of Search ..... 84/304, 305, 306

[56] References Cited

U.S. PATENT DOCUMENTS

| | | | |
|---|---|---|---|
| 1,561,566 | 11/1925 | Purdy | 84/306 |
| 1,579,987 | 4/1926 | Wickes | 84/305 |
| 1,669,823 | 5/1928 | Grover | 84/306 |
| 4,026,182 | 5/1977 | Gilbrech | 84/305 |

*Primary Examiner*—Lawrence R. Franklin

*Attorney, Agent, or Firm*—Gilbert L. Wells; Heinrich W. Herzfeld

[57] ABSTRACT

Fine-tuning peg for a stringed instrument having a holder for holding the peg firmly in a peg box of the instrument. The peg has a head which is partly hollow, a tuning wheel in the interior of the peg head, a neck part, a rotatable tuning shaft is supported in the neck part and the rotatable tuning shaft is connected to the tuning wheel. A pre-tuner is associated with the free end of the tuning shaft and a string drum is seated on the tuning shaft. A device for compensating the pull of the string is connected to the tuning shaft and a disengageable locking mechanism is adapted for securing the string against turning.

12 Claims, 12 Drawing Figures

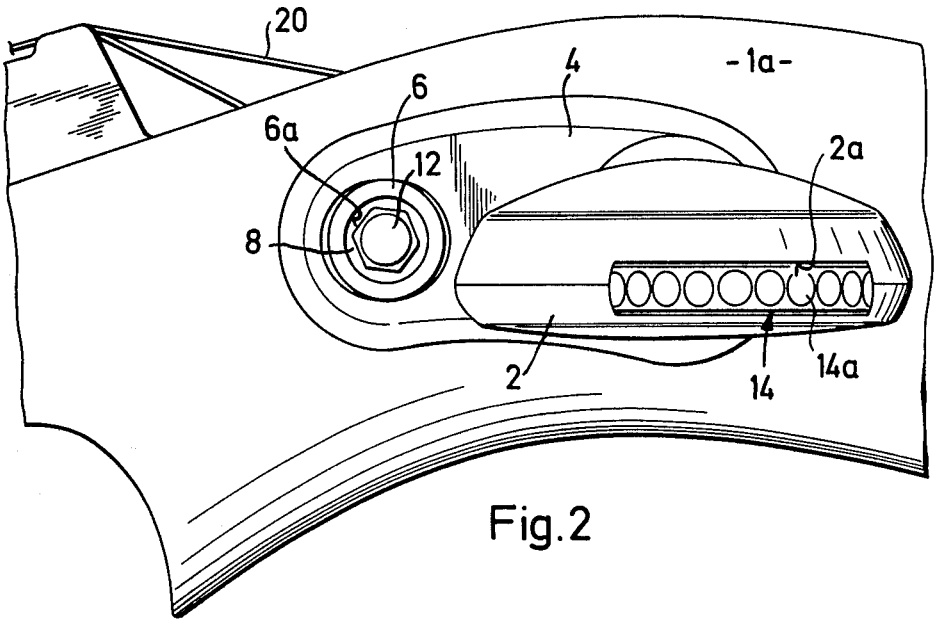
Fig.2
Fig.3
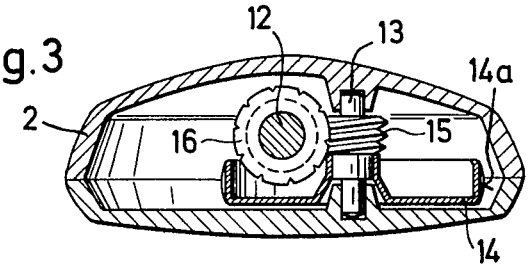
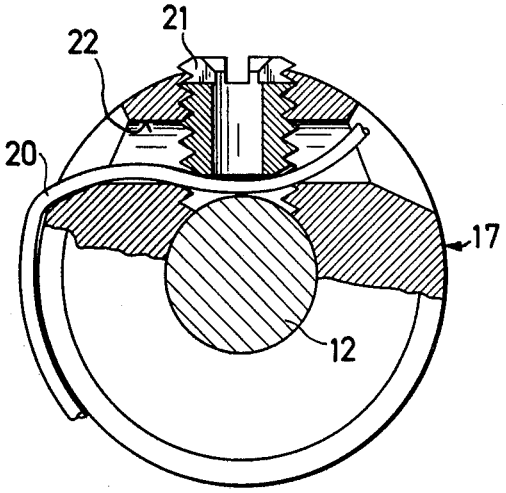
Fig.4

FINE TUNING PEG

The invention relates to a fine-tuning peg which is suitable for use on a stringed instrument and has means of fixing in order to hold the peg firmly in the peg box of the stringed instrument, against being loosened by the pull of the string, and which comprises a peg head, which is partly hollow and can be firmly fixed at the peg box of the stringed instrument, and a tuning wheel in the interior of the peg head as well as a neck part with a tuning shaft, which is supported therein and is connected to the tuning wheel in such a way that it can be turned by the latter, and a string drum seated on the tuning shaft.

The known stringed instruments as a rule possess a peg box which has a scroll and is delimited by the nut, at which the neck mounted on the sound box of the instrument starts. In the case of a violin, for example, two pegs each, by means of which the strings are tuned, are located on the left and on the right, projecting into the peg box. With the customary pegs, the clamping force on the cone, which is necessary to obtain a secure hold, must be substantially larger than the pull, already in itself considerable, of the string which is fitted on a string drum.

The ease with which these known pegs can be moved is generally inadequate to make it possible for the person playing the instrument easily to effect fine-tuning of a given string by adjusting, with the left hand, the lever holding it, when the instrument is held in the usual way, while, at the same time this string is bowed with the right hand as usual. Furthermore, an additional pressure in the direction of the axis of the string drum is necessary when turning the peg in order to prevent its becoming loose.

When bowing the string it is hardly possible, especially in the case of violins and violas, to operate the additional fine-tuning devices which have hitherto been proposed and comprise levers and/or screws. Tuners which have a worm-wheel reduction and are known, in particular, for plucked stringed instruments, have also been proposed for double basses. They are, however, unsuitable for a violin, viola and cello, if only for stylistic reasons.

The fine-tuning peg of the type described initially, such as has been described by Georg Wolff in German Pat. Specification 677,242, also has a tuning wheel which is supported in the peg head of the firmly clamped peg and is seated directly on one end of the tuning shaft which is supported in the peg shaft, and which tuning shaft can be moved axially therein and has the shape of a threaded spindle.

Because of high friction losses, this known peg permits fine-tuning only with the application of a relatively large force. Furthermore, since re-tuning is only possible very coarsely by loosening the peg in the peg box, it is necessary for fine-tuning to turn the tuning wheel by two fingers gripping around both sides of the peg. There is also no device for compensating the pull of the string. The only locking mechanism possible in this case is a guide pin firmly clamped in a helical slot running around the peg shaft.

It is true that, on turning in the tuning shaft, the string drum could be moved axially in the direction away from the peg head, whilst tensioning the string present on the drum with an increased effort, but the clamping of the guide pin in the helical slot would in this case strongly impede the turning-back of the string drum, and the movement of the string drum following behind the threaded spindle, which latter is being screwed back, would then be uncertain and irregular.

It is therefore an important object of the present invention to provide a fine-tuning peg which makes it possible, whilst the instrument is securely held in the normal way, easily to effect fine-tuning of a string, bowed by the bow held in the other hand, with one finger of the hand holding the instrument, a reliable response of the element carrying the string being fully ensured in the case of both sharp tuning and flat tuning.

It is also an object of the invention to provide a fine-tuning peg of such a type that it can, as desired, be mounted and removed from stringed instruments of normal construction without modification of the latter.

It is a further object of the invention to provide a fine-tuning device with great ease of movement, in which the string tension can be largely or completely compensated by an adjustable counter-tension, so that small changes in the tension of the string can easily be accomplished by adjusting the tuning wheel with the end of one finger. In this adjustment, the smallest possible change in the tension of the string should correspond to a long path of the finger tip.

This object is achieved by a fine-tuning peg of the type described initially, which, in accordance with the invention, is characterized in that the string drum is secured, during fine-tuning, against a shift in the axial direction on the turning shaft, that a device for compensating the pull of the string is connected to the tuning shaft, by means of which device a pull, exerted on the tuning shaft by the string via the string drum, is largely or completely compensated, and that a disengageable locking mechanism is provided which secures the string drum against turning, relative to the tuning shaft, in the sense of the direction of the pull of the string, but permits a mutual twisting of the string drum and the tuning shaft in the opposite direction, so that it becomes possible to adjust the pre-tuning means.

Preferably, the connection between the shaft of the tuning wheel and the tuning shaft can here consist of a wormgear accommodated in the interior of the peg head.

The string drum with an extension which is suitable for adjustment by an adjusting key preferably projects through the wall, facing away from the peg head, of the peg box, and the disengageable locking mechanism preferably prevents the string drum, after a string fastened thereon has been tensioned, from turning back relative to the tuning shaft, whilst the locking mechanism is engaged.

Furthermore, the locking mechanism can preferably comprise a locking string element which is located on the tuning shaft and can be compressed or narrowed in an axial direction, in order to release the locking mechanism.

The device for compensating the pull of the string can possess a compensating spring which is placed around the tuning shaft, is supported in a bush firmly seated on the tuning shaft and counteracts the pull of the string on the tuning shaft.

A stop device which secures the peg head against unintended twisting can be provided on the wall of the peg box. Preferably, this stop device can be released by an axial movement of the peg head in the direction away from the peg box and the peg head can thus be turned.

Moreover, the tuning wheel can preferably be seated on a tuning wheel shaft which is supported, so that it can turn, in the peg head, transversely to the longitudinal axis of the tuning shaft. An edge part of the tuning wheel can here protrude through an orifice in the wall at the outer edge, facing away from the peg box, of the peg head, so that it can be turned from outside.

The locking mechanism can possess a first toothed rim, which is firmly seated on the string drum, and a second toothed rim, which is firmly inserted in the string drum and, during fine-tuning, positively engages with the first toothed rim, this engagement being released, during pre-tuning, by adjusting the string drum. In this case, the locking mechanism can include a compression spring element which is supported, on the one hand, on the tuning shaft and, on the other hand, on the toothed rim and which puts a load on the latter in order to effect engagement.

The string drum can form, in its interior and around the tuning shaft, a first annular chamber, into which a bush rigidly joined to the tuning shaft projects, and a preferably cylindrical helical spring, biased for clamping, in the ring chamber can make contact around the bush, one end of the helical spring being joined to the string drum, and the joint of the spring to the string drum is free from tension when no pull of the string acts on the latter, and, when the string drum is turned for pre-tuning which releases the tension of the string, the spring can be twisted via its end so that the windings are extended, and can then freely slide on the bush.

The worm-gears are known per se. Since they alone do not enable tuning to be carried out with sufficient ease and especially require excessive differences between the forces needed for sharp tuning and flat tuning, the major part of the pull of the string advantageously is absorbed by the said compensating spring element in the fine-tuning peg, according to the invention, which includes a worm-gear in rotatable engagement with the tuning shaft which is located inside the actual, non-rotatable peg. Tensioning of the compensating spring element is here made possible by pre-tuning with the aid of the abovementioned locking mechanism which can be actuated by a key from the other end of the peg. In this way, the tuning wheel which projects from the head part, similar to the handle of a peg, of the fine-tuning peg according to the invention can now easily be turned by the fingertip of the thumb of the left hand rolling over it, while the other fingers support the scroll.

If the left-hand peg heads of the left-hand low strings G and D are mounted in such a way that their tuning wheels point obliquely upward and forward, that is to say towards the fingerboard, and the tuning wheels of the right-hand strings A and E point downward and forward, at approximately right angles to the former, this results in the very important advantage that subjectively the same actuating direction always effects the sharp tuning or flat tuning of all the fine-tuning pegs, that is to say a pulling movement of the thumb preferably always serves for pulling up but a pushing movement of the thumb serves for pushing back. This arrangement also has the special advantage that, when the thumb changes from one side of the peg box to the other, the other fingers of the left hand can always remain in the same position in order to hold the instrument securely by its scroll.

It is a further advantage that, in contrast to known lever fine-tuners, the tuning range is not fundamentally limited. The form of the new peg can also be readily matched to the stringed instrument, for example a violin, and can be shaped in such a way that it does not conspicuously differ from the customary wooden pegs.

Further details of the invention can be seen from the description, which follows, of a preferred embodiment thereof by reference to the attached drawing, in which FIG. 1 shows, partially in axial section, a peg box with two fine-tuners according to the invention, incorporated therein;

FIG. 2 shows a side view of the peg box part shown in FIG. 1, with a peg head and a fine-tuner accommodated therein;

FIG. 3 shows a cross-section through a peg head in the plane indicated in FIG. 1 by III — III;

FIG. 4 shows a cross-section through a string drum in the plane indicated in FIG. 1 by IV — IV;

Figure 1:
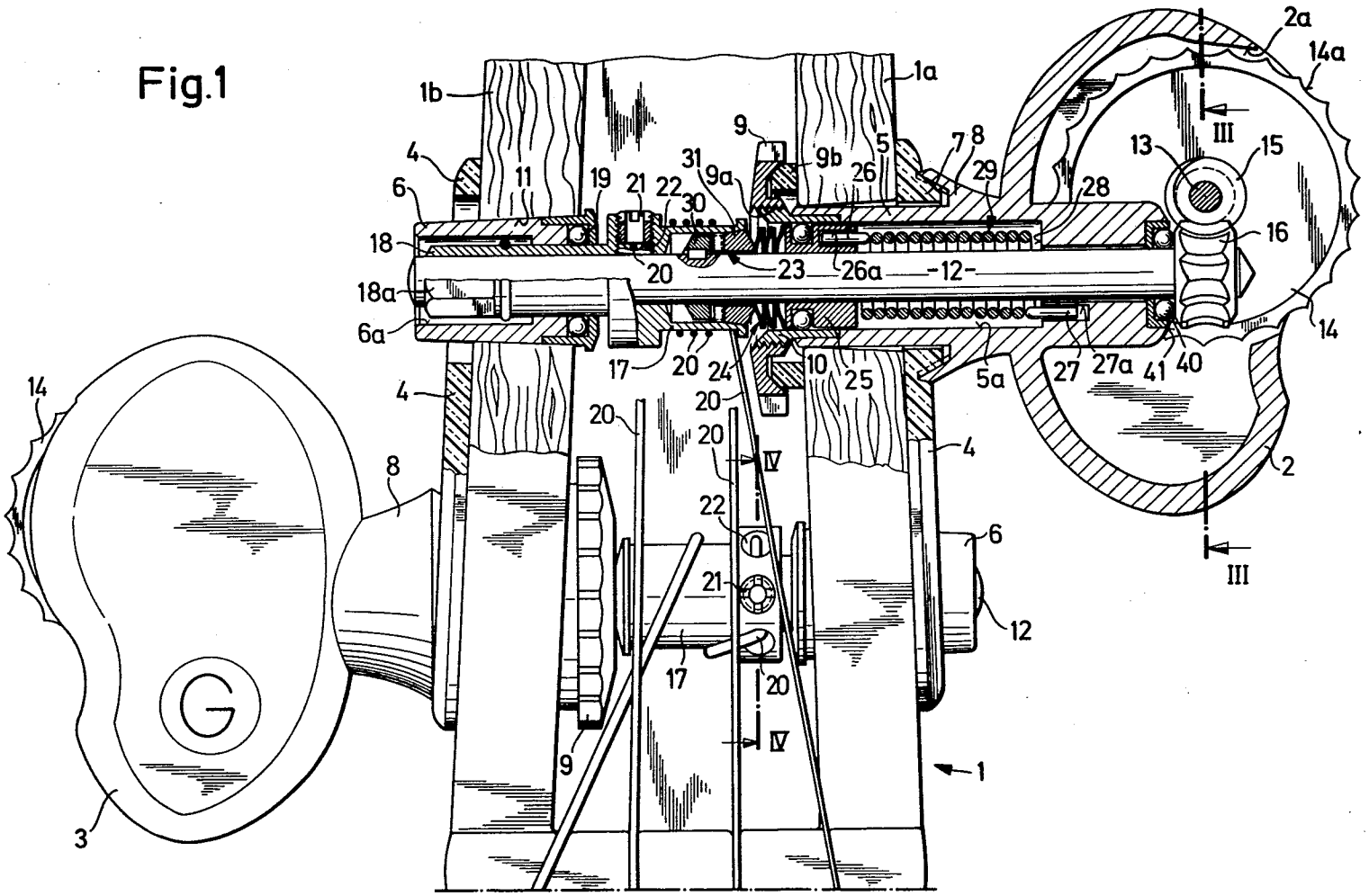

As can be seen from FIG. 1, two peg heads 2 and 3 are firmly built into the peg box 1 of a violin or a similar stringed instrument, and specifically the peg head 2 is built into the peg box wall 1*a*, which is on the right as viewed by the violin player, and the peg head 3 is built into the box wall 1*b* on the left. Each of the peg heads 2, 3 must be built into the wall of the peg box in such a way that they are secure against a shift in an axial direction and also against rotation. It is necessary that the requisite fastening elements can be adapted to deviations in the position of the wall surfaces of the peg box, which never have accurate dimensions; the normal inclined position of these wall surfaces must also be compensated by corresponding shaping of the fastening agents. Securing plates 4, which preferably are manufactured from glass-clear plastic material and thus are hardly visible, serve to secure the peg heads against twisting. The securing plates 4 make flat contact with the outer walls. They have a wider end and a narrower end, the wider end surrounds the shaft 5 of the peg 2 to be secured, whilst the conically tapered bush 6 of the adjacent peg 3 protrudes through the narrower end of the securing plate 4. In this way, the securing plates 4 themselves are secured against twisting or turning on the outer surface of the box wall. Towards the wider end, the securing plate 4 carries an extension 7 of frustoconical shape, which protrudes into the hollow interior of a collar part 8, which has the shape of an outwardly projecting truncated cone, on the shaft 5 of the peg head. Preferably, the collar part 8 is knurled on its annular conical inner wall and can thus be pressed, providing securing against twisting, into the conical annular surface of the extension 7, which preferably is manufactured from a somewhat softer material than the shaft of the peg, by tightening the tightening nut 9 which is screwed by means of the thread 9*a* onto the bush 10 which is firmly inserted into the shaft 5 of the peg head, an elastic washer 9*b* resting on the inside of the box wall 1*a*. This washer 9*b* has, on the side facing the sound box, a sufficiently greater thickness than on the opposite side, in order to compensate the inclination of the box wall. The outer surface of the washer 9*b* here has a rounded profile, against which the nut 9, which has a hollow shape with a conically chamfered inner ring surface, rests. In a peg hole 11 of the opposite box wall 1*b*, the bush 6 is supported, so that it cannot be turned, in alignment with the peg shaft 5. The center of a tuning shaft 12 and one of its ends are supported in the interior of the shaft 5 of the peg head and of the peg head 2 itself, respectively, and its other end is supported in the bush 6. The gearing mechanism of the fine-tuner is now built into the peg head 2.

This mechanism includes the tuning wheel 14 (FIG. 3) which is borne by the tuning wheel shaft 13 and projects through the orifice 2*a* in the wall of the peg head 2, the inside of which is hollow. To facilitate operation, the tuning wheel 14 preferably has a knurled rim 14*a*. Furthermore, the worm 15 which engages with a crown wheel 16 on that end of the tuning shaft 12 which projects into the peg head 2, is seated on the shaft 13 of the tuning wheel. A string drum 17 which extends into the bush 6 by a sleeve part 18 surrounding the tuning shaft 12 and is supported, so that it can turn, in the bush by means of a ball-bearing 19, is loosely seated on the tuning shaft 12 in the central range thereof between the two peg box walls is 1*a* and 1*b*. The free end of the sleeve part 18, which projects into an outwardly opening recess 6*a* of the bush 6, ends in a hexagon 18*a* which fits a pre-tuning key (not shown). With the aid of the pre-tuning key, the string drum 17 can be turned relative to the tuning shaft 12 and a string 20 fastened thereon can be pre-tensioned.

Preferably, the string 20 not only is threaded in, but is also additionally pre-secured by a transverse screw 21 to such an extent that a few smoothly adjacent windings of the string suffice for a secure hold thereof on the string drum 17 (FIG. 4). In this way, the usual mere threading of the string into the orifice 22 in the string drum 17, followed by multiple cross-over windings of the string, is avoided.

After the said pre-tensioning of the string, the drum is secured against turning back by a locking mechanism 23 which is in itself known and which is pressed in the direction towards the bush 6 by a set of locking springs 24, which is supported in a bush 10 inserted into the cavity 5*a* of the peg shaft 5. A ball-bearing 25 which is firmly seated on the tuning shaft 12 and which can be turned relative to the inner wall of the cavity 5*a* in the region of the bush 10 of the peg shaft 5, serves as the abutment for the set of locking springs 24.

Figure 5:
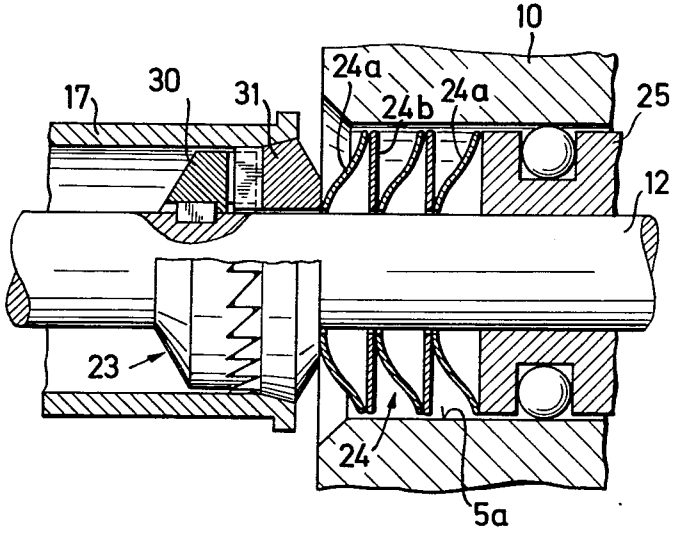
FIG. 5 shows an enlarged representation of a locking mechanism on the tuning shaft, which interacts with the string drum, in the non-compressed state

As shown in the enlarged representation in FIG. 5, the locking mechanism consists of two mutually engaging toothed rim members 30 and 31, the former of which is rigidly joined to the tuning shaft 12, whilst the second is firmly inserted into the string drum 17. Mutual engagement of the two toothed rim members is effected by the set of locking springs 24, the set of springs 24 which is supported on the ball-bearing 25 pressing the toothed rim member 31, joined to the string drum 17, of the locking mechanism 23 into the toothed rim member 30 joined to the tuning shaft 12. The set of springs 24 consists of a number of annular springs, and each curved annular spring 24*a* is supported on a flat annular spring 24*b*, whilst one of the outermost annular springs of the set, which are both curved, is supported on the ball-bearing 25 and the other is supported on the toothed rim member 31 joined to the string drum 17.

When the string drum 17 is adjusted clockwise (as viewed from the peg head 2) by means of a key fitting the hexagon 18*a* so that the set of springs 24 is compressed, the toothed rim member 31 slides out of engagement with the toothed rim member 30 which latter is held in place, against twisting, by the worm 15 via the crown wheel 16 and the tuning shaft 12. During this procedure, the string 20 is tensioned. After the key has been withdrawn, the string 20 tries to turn the string drum 17 back counterclockwise, but the set of springs 24 now presses the toothed rim member 31 into locking engagement with the toothed rim member 30 on the tuning shaft 12.

Figure 6:
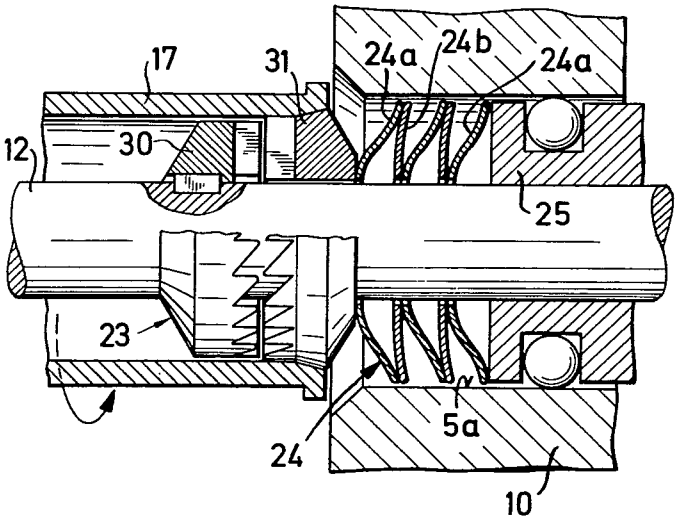
FIG. 6 shows the same locking mechanism in the compressed state.

During the compression in the direction towards the peg head 2, the flat annular springs 24*b* in the set of springs 24 are deformed, whilst the pre-formed, curved springs 24*a* are flattened to a corresponding extent (FIG. 6).

One end 26 of a balancing spring 29 surrounding the tuning shaft 12 is inserted in a recess 26*a* of the ball-bearing 25, whilst its other end 27 is inserted in a second recess 27*a* in the end wall 28 of the cavity 5*a* of the shaft 5 of the peg head. This balancing spring 29 tends to reset the tuning shaft 12 against the pull of the string into its position relative to the peg 2, when the string is not under tension. For a release, the locking mechanism 23 can be disengaged by axial pressure with the key and the compression, thus resulting, of the set of locking springs 24.

Pre-tuning starts with the balancing spring 29 at first only slightly tensioned, by first tightening the string 20 somewhat with the aid of the pre-tuning key turning the string drum 17, whereupon the string is tuned down again, that is to say somewhat relaxed again, by turning the tuning wheel 14, the rotation of which is transferred via the worm 15 to the crown wheel 16 and hence to the tuning shaft 12. By the adjustment of the tuning wheel 14 which does not move too easily, the balancing spring 29 is tensioned without overloading the entire gear mechanism, since the pull of the string and the tension of the balancing spring 29 are always approximately in balance even if the pre-tuning process and tuning down process is repeated during the gradually progressing tuning. In final tuning, the ratio (pull of the string) : (tension of the spring) in itself can then be selected as desired, but preferably in such a way that this ratio on the one hand corresponds to the natural perception whilst tuning, but on the other hand also keeps the gear mechanism free from play.

In order to make the tuning of the strings as easy as possible, the frictional resistance to turning must be reduced to a minimum. This purpose is served by supporting the tuning shaft 12 and the string drum 17 in the ball-bearings 19 and 25 and also in the ball-bearing 40 which is firmly built into the end wall 41, of the peg shaft 5, situated in the hollow interior of the peg head and on which the crown wheel 16 runs. The bearings 19 and 25 which are most highly stressed by pressure here lie as close as possible to the insides of the walls 1*b* and 1*a* respectively of the peg box 1.

In the second embodiment of the fine-tuning peg according to the invention the fixing device comprises a string drum 117, the sleeve part 118 of which projects outwards through the left-hand box wall 1*b* and the projecting part of which has a hexagonal shape. The hexagon of the sleeve part 118 serves for pre-tuning in the same manner as the hexagon 18*a* in the first embodiment.

The string drum 117 is secured against turning back in the direction of the pull of the string by the locking spring 34 which is situated in an annular chamber 33 within the string drum 117 around a bush 125, accommodated in the latter and rigidly joined to the tuning shaft 12, and the flattened end 35 of which projects into the groove 36 of a locking spring holder 37. The latter is seated in a recess 38 of the string drum 117, extending transversely to the axis of the drum.

The locking spring 34 is seated on the bush 125 and has a slight bias which increases as the spring starts to turn, if this turning of the spring is effected via the string drum 117 starting at the end 35 of the spring in the direction in which the spring is wound onto the bush 125, so that the spring 34 and the bush 125 jam and produce locking; the spring 34 can then easily be turned on the bush 125 in the opposite direction since the initial friction between the bush 125 and the spring 34 has the effect that the windings of the latter expand easily and hence reduce the friction.

Figure 7:
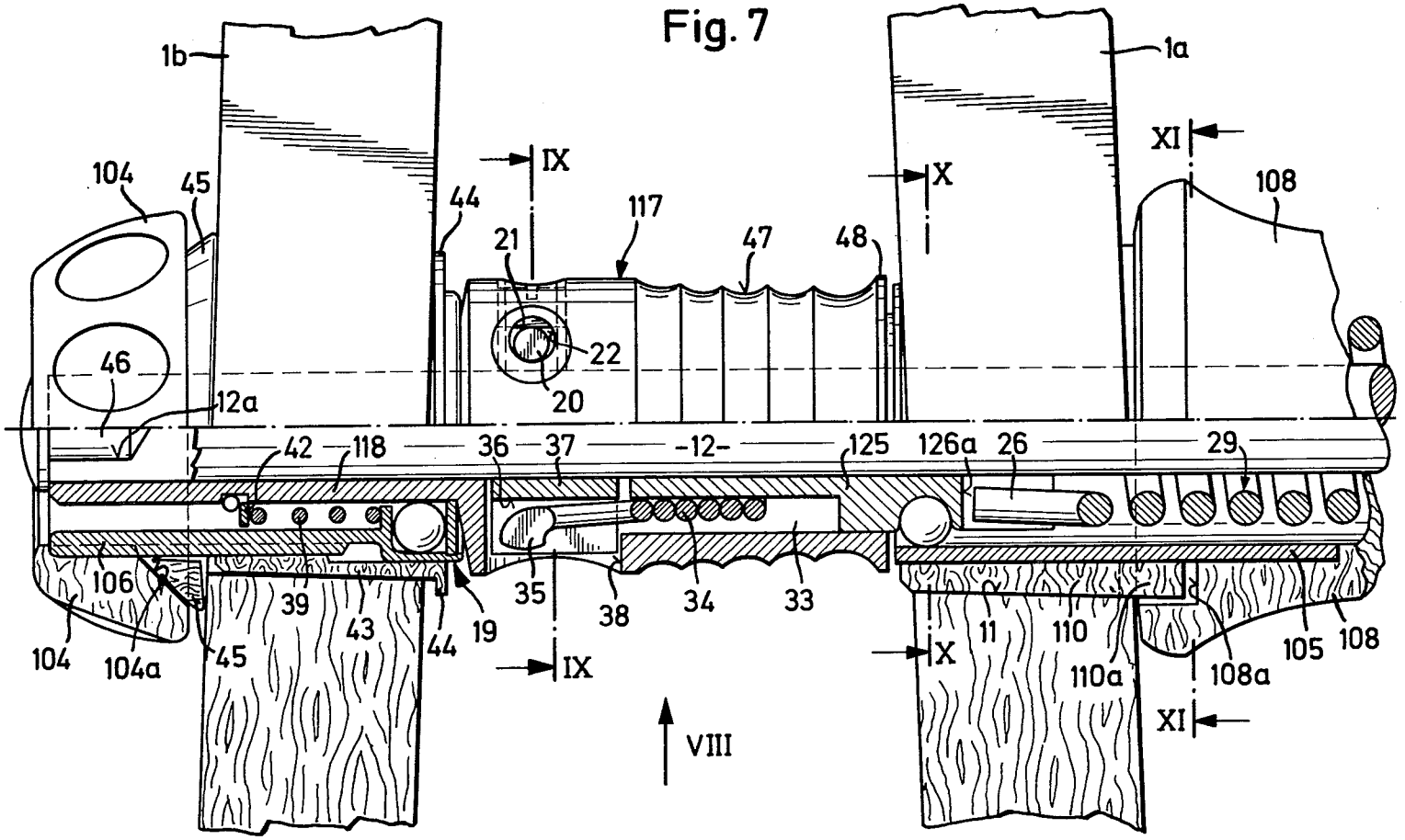
FIG. 7 shows a peg box with another embodiment of a fine-tuner incorporated therein, partially in axial section and omitting the major part of the peg head.
Figure 9:
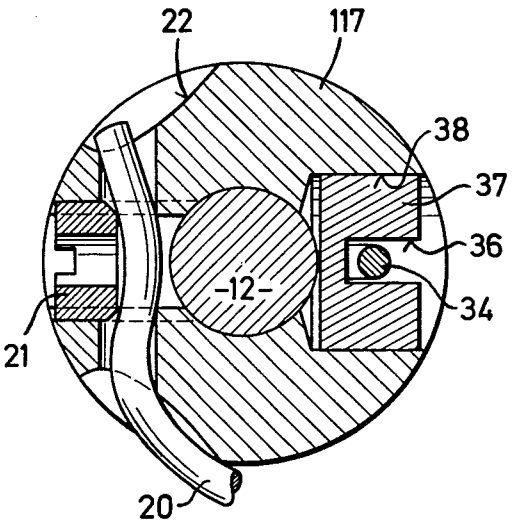
FIG. 9 shows a partial view through this central part along the plane characterised in FIGS. 7 and 8 by IX — IX.
Figure 8:
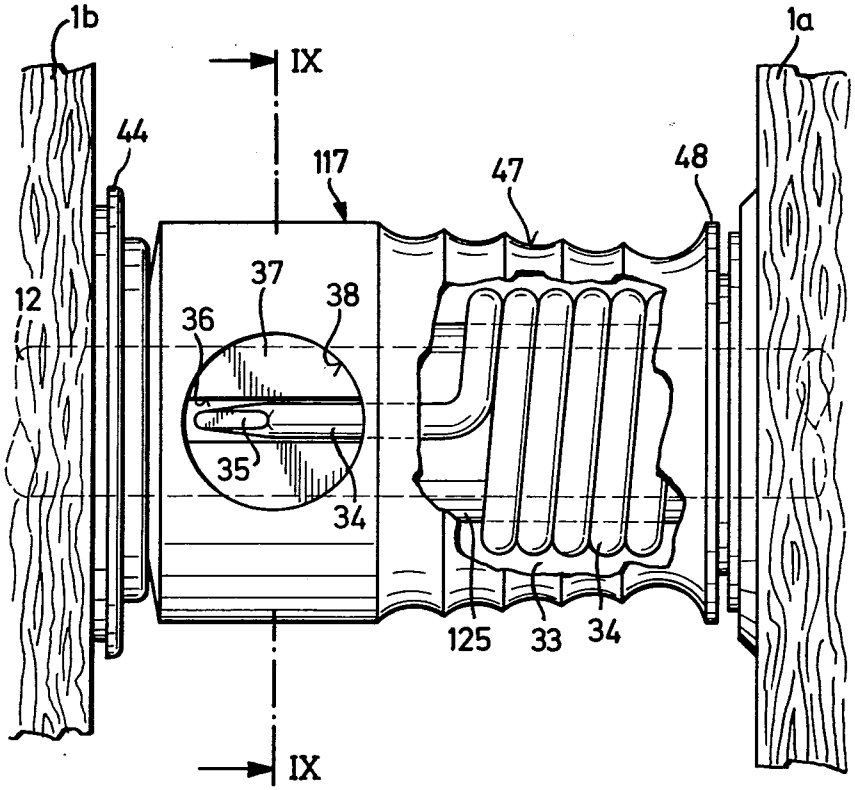
FIG. 8 shows a view of the side, facing the body of the instrument, of the central part of the fine-tuner, located between the two box walls.

In FIGS. 7 and 8, the locking spring 34 is shown with a winding in the sense of a left-handed thread. This means that, when the string 20 is tensioned, the drum 117 must be turned clockwise, as viewed from the right, that is to say from the peg head 2. Accordingly, the drum 117 must be locked in the opposite direction against the bush 125 joined to the tuning shaft 12, since the windings of the spring 34 over the bush 125 are wound up by the drum via the end 35 of the spring in the sense of narrowing the windings and are thus jammed on the bush 125. If, however, the drum 117 is turned by the pre-tuning key itself in the abovementioned direction of tensioning the spring, it then takes the end 35 of the string along in the sense of relaxing the spring, that is to say expanding the windings, so that the spring 34 can then freely slide on the bush 125.

One end 26 of the balancing spring 29 engages with the recess 126*a* of the bush 125 and its other end 27 is supported in the recess 27*a* of the peg head 2 in the same way as in the first embodiment.

In the instant embodiment, the fastening, secure against turning, of the fine-tuning peg in the peg box wall is effected in a manner similar to that shown in the embodiment of FIGS. 1 to 6.

It is, however, desirable to loosen the fine-tuning peg from its fastening in the peg box wall to such an extent that it can also be turned around the axis of the tuning shaft, in particular for the purpose of changing a string.

Figure 11:
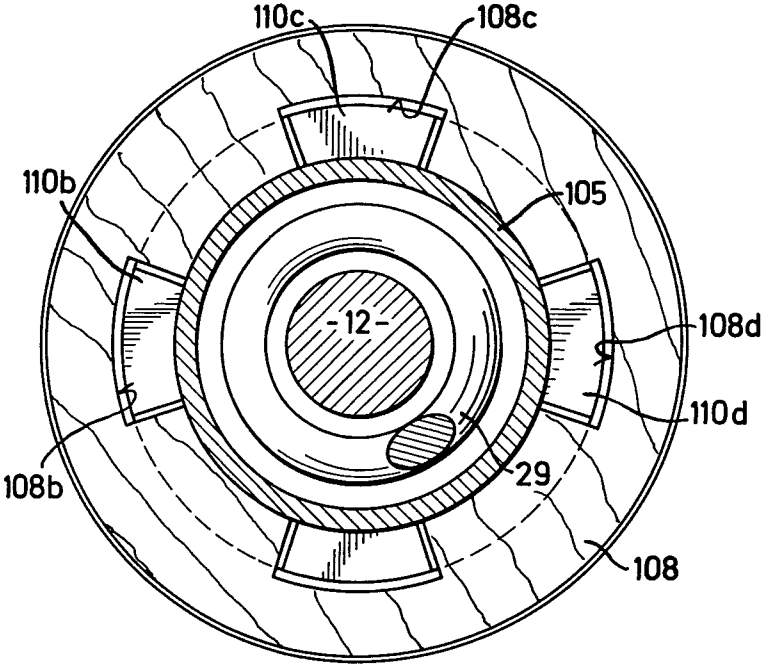
FIG. 11 shows a similar cross-section, but along a plane indicated in FIG. 7 by XI — XI.
Figure 10:
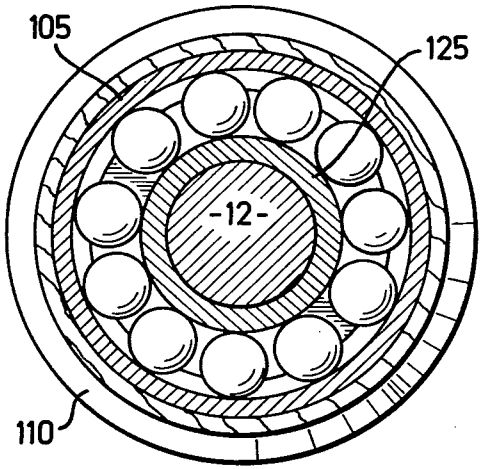
FIG. 10 shows a partial view of the embodiment of the fine-tuner shown in FIG. 7, along the plane indicated in FIG. 7 by X — X.
Figure 12:
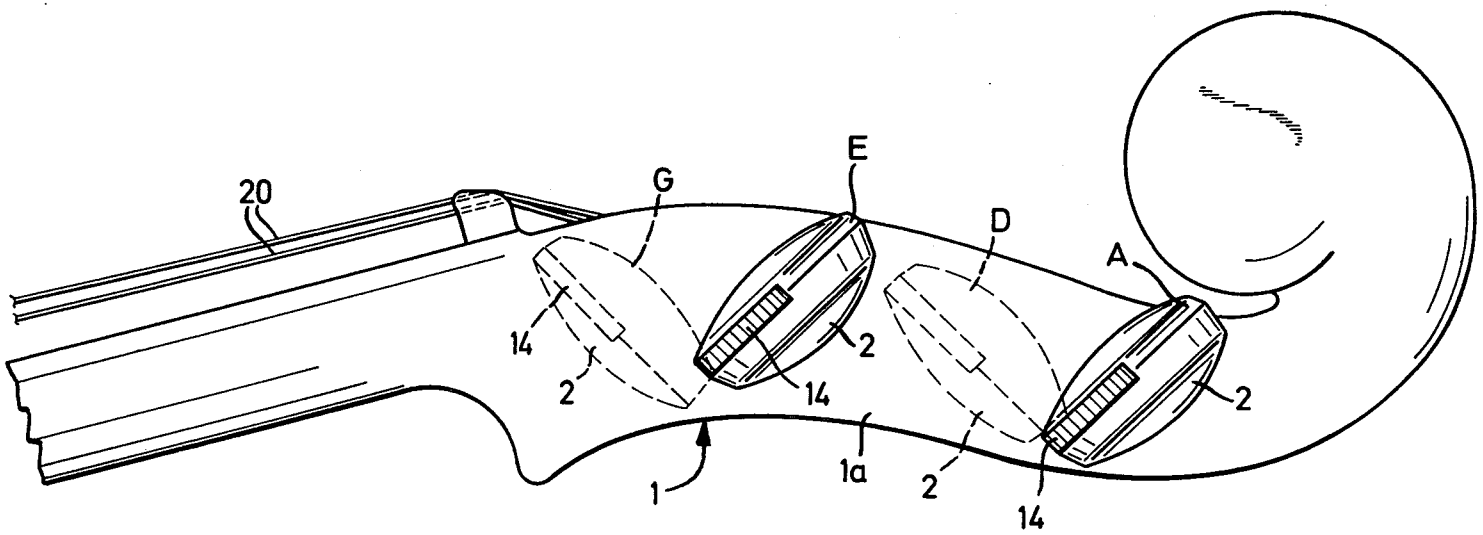
FIG. 12 shows a side view of the peg box with four fine-tuning pegs according to the invention mounted thereon.

In the embodiment according to FIGS. 1 to 6, it would be necessary to loosen the tightening nut 9 for this purpose. In the embodiment according to FIGS. 7 to 11, however, this is effected in a simpler manner by axially pulling the peg head 2 in the direction out of the peg box 1, and specifically against the action of a compression spring 39 which is located in the interspace between the sleeve part 118 and a threaded bush 106 surrounding the latter and which is compressed by a collar 42 fixed to the tuning shaft 12, when the latter undergoes a limited axial movement as a result of the pull on the peg head 2. The cylinder 105 which is rigidly joined to the neck 108 of the peg head 2 then slides, in a crown bush 110 inserted into the peg box wall 1*a*, so far outwards that the crown segments 110*a*, 110*b*, 110*c* and 110*d* lose engagement with the recesses 108*a*, 108*b*, 108*c* and 108*d* opposite thereto (FIG. 11). The peg head 2 can now be turned in any desired direction until one of its recesses 108*a* to 108*d* again coincides with one of the crown segments 110*a* to 110*d* of the crown bush 110, and when the peg head 2 is then released, the spring 39 effects a firm seating of the peg head on the peg box 1, the crown segments engaging with the corresponding recesses of the peg head.

Fundamentally, the fastening, secure against turning, of the crown bush 110 in the peg box wall 1*a* takes place in accordance with the principle of clamping on a cone, as is customary with wooden pegs, but with the difference that a firmer joint is obtained in this case, it being no longer necessary, in contrast to the previously known pegs, that the bush 110 can still be turned. On the contrary, adhesives should therefore be used in this case in place of the customary slip lubrications. If a firm bond is omitted, in order to be able to replace the crown bush 110, a prior bushing of the peg hole 11, which is free from lubricant, with a solution of a soft resin has proved useful. The security against turning can also be further increased by providing the outer surface of the crown bush 110 with a fine, sharp knurling. Of course, a well-matched fit it also a prerequisite in this case. Since the peg holes 11 in stringed instruments are not yet standardized, this can be achieved, when the new fine-tuning pegs are built afterwards into old violins, either by re-reaming the peg holes to the intended dimension or by also supplying crown bushes with stepped outer dimensions. The latter is possible because a very narrow dimensional tolerance is not required when the crown bush 110 is firmly pressed in, although care must be taken that the dimensioning of the crown segments 110*a* to 110*d*, which slightly project beyond the peg box wall in order to engage with the peg shaft 105, is approximately correct. A special screwing tool can be used for pulling the crown bush 110 out again, without using force.

Since the seating of the small peg end (sleeve part 118) does not need to be secured against turning, an approximate matching of the dimensions suffices here. The element used in this case for equalizing the dimensions is a split clamping bush 43 which has an internal thread and a wide longitudinal slit and, in the state when it has been taken out of the peg box wall 1*b*, that is to say in the relaxed state, has a diameter somewhat greater than corresponds to the outer thread of the threaded bush 106. The effect of this is that it must be compressed, when it is inserted into the peg box wall 1*b*, and thus already jams in the peg hole 11 under a certain external pressure. Firstly, this facilitates an accurate adjustment of the axial position of the fine-tuning peg, since the threaded bush 106 can be displaced in the clamping bush 43 by screwing using a clamping key which grips it from its inside, and secondly, this makes it easier to overcome small deviations in dimensions, because a fit between the two threaded parts is not necessary here.

After the fine-tuning peg has been axially adjusted, the clamping bush 43 must be locked in its position by the nut 104 via the threaded bush 106, its flange 44 abutting against the inside of the left-hand box wall 1*b*.

In particular, this is necessary also because, when the peg head 2 is pulled forward in order to disengage the neck 108 and the crown bush 110, the pressure of the compression spring 39, which is then compressed, bears on the threaded bush 106. However, since the position of the outer wall is not perpendicular, but somewhat inclined to the axis of the tuning shaft 12, an intermediate disc 45 is required which compensates this irregularity and is spherically rounded on the side of the nut and the axis of which necessarily assumes, under the action of the internal conical surface 104*a* of the nut 104, a position perpendicular to the outside of the box wall 1*b*.

Since the axial pull on the peg head 2 must be transmitted via the tuning shaft 12 to the string drum 117, the latter is secured against axial displacement, at its sleeve part 118 which is provided with a hexagon, by a pin 46 which is inserted, and firmly seated, in a recess 12*a* of the end face of the tuning shaft 12.

In order to avoid the unreliable mere threading-in of the strings, which is followed by multiple cross-over windings, the string 20 is pre-secured, as in the first embodiment, by a transverse screw 21 in the orifice 22 to such an extent that at most a few smoothly adjacent windings then suffice for a secure hold of the string. In order to present a better hold of the string, even for these windings, on the string drum 117, the latter is provided with flat, concentric guide grooves 47. If the diameter of the latter slightly narrows towards the peg head 2, this results in a raised rim 48 at that end of the string drum 117 which faces the peg head 2, and this rim 48 effectively prevents the troublesome scraping of the last winding on the box wall 1*a*. Particularly regular windings result if the guide groove 47 itself is wound helically.

The locking spring holder 37 in the form of a slit cylinder (FIG. 9) is seated in a recess 38 of the string drum 117 opposite the transverse screw 21. This holder is necessary in order to ensure a secure and distortion-free fastening of the locking spring 34, and this in turn is an important pre-requisite if the spring is to function perfectly and, above all, with little play. This is so because a firm seating, which is accurately parallel to the axis and moreover free from play, of the flattened fastening end 35 of the spring 34 in a narrow drilled locating hole can hardly be achieved technically, and even less can a precise coincidence, without transition, of the angling-off of the spring end 35 with the end of the curvature of the last winding of the spring 34 be expected, and this would indeed be a condition if the position of the drilled locating hole were to coincide with the diameter of the spring. All these difficulties are avoided by placing, according to the invention, the spring end 35 in the groove 36 of the rotatable locking spring holder 37. In this case, the spring end 35 can then point outwards within wide limits.

As shown in FIGS. 7 and 8; likewise, the angular deviations transverse thereto are automatically compensated by turning the cylindrical locking spring holder 37 in the recess 38. A laterally flat tapering of the spring end 35 makes it easier to thread it into the groove 36. Additionally, however, an axial locking of the spring end 35 also is necessary. This can easily be achieved by filling the groove 36 with a hot-melt cement or a solder or adhesive. If in this case the spring end 35 has been shaped to point outwards, as shown, or deformed in another way, its locking in position is ensured even if no reliable surface bond with the filler is obtained.

I claim:

1. A fine-tuning peg which is suitable for use on a stringed instrument and comprises fixing means adapted for holding the peg firmly in a peg box of the stringed instrument, against being loosened by the pull of the string, a peg head which is partly hollow and adapted for being firmly fixed at the peg box of the stringed instrument, a tuning wheel in the interior of the peg head, said peg head having a neck part, a rotatable tuning shaft being supported in said neck part and being connected to said tuning wheel for turning the latter, pre-tuning means associated with the free end of said tuning shaft, a string drum seated on said tuning shaft, means for securing said string drum, during fine-tuning, against a shift in axial direction on said tuning shaft; a device for compensating the pull of the string being connected to said tuning shaft, by means of which device a pull, exerted on the tuning shaft by the string via the string drum, is largely or completely compensated; and a disengageable locking mechanism adapted for securing the string drum against turning, relative to the tuning shaft, in the sense of the direction of the pull of the string, but permitting a mutual twisting of the string drum and the tuning shaft in the opposite direction, whereby it becomes possible to adjust the pre-tuning means.

2. A fine-tuning peg as described in claim 1, further comprising worm gear means connecting said tuning wheel and said tuning shaft, said worm-gear means being accommodated in the interior of said peg head.

3. A fine-tuning peg as described in claim 2, wherein said string drum comprises an extension which is adapted to be adjusted by an adjusting key insertable through a wall of said peg box facing away from the peg head whereby said disengageable locking mechanism, while engaged, prevents said string drum from turning back relative to said tuning shaft after a string fastened thereon has been tensioned by said pre-tuning means.

4. A fine-tuning peg as described in claim 3, wherein said locking mechanism comprises a locking spring element which is located on the tuning shaft and can be compressed or narrowed in an axial direction, in order to release said locking mechanism.

5. A fine-tuning peg as described in claim 4, wherein said device for compensating the pull of the string comprises a compensating spring which is placed around the tuning shaft, and a bush firmly seated on the tuning shaft and on which said compensation spring is supported to counteract the pull of the string on the tuning shaft.

6. A fine-tuning peg as described in claim 5, further comprising a stop device which is adapted for being mounted on the wall of the peg box and secures the peg head against unintentional twisting.

7. A fine-tuning peg as described in claim 6, wherein said stop device is releasable by an axial movement of said peg head in the direction away from the peg box and the peg head can thus be turned.

8. A fine-tuning peg as described in claim 4, wherein said locking mechanism comprises a first toothed rim member which is firmly seated on said string shaft, and a second toothed rim member which is inserted in the interior of said string drum and, during fine-tuning, positively engages with the first toothed rim member, this engagement being released, during pre-tuning, by shifting the string drum.

9. A fine-tuning peg as described in claim 8, wherein said locking mechanism comprises a compression spring element which is supported, on the one hand, on said tuning shaft and, on the other hand, on said second toothed rim member and which biasses the latter into engagement with the first toothed rim member.

10. A fine-tuning peg as described in claim 4, wherein said string drum has, in its interior and around said tuning shaft, an annular chamber, said locking mechanism further comprises a bush rigidly joined to the tuning shaft, which bush projects into said annular chamber, and a helical spring biased for clamping and being housed in said annular chamber and making contact around the bush, one end of said helical spring being free and the other end joined to said string drum, and the joint of said helical spring to said string drum being free from tension, when no pull of the string acts on the latter, and when the string drum is turned for pre-tuning, which releases the tension of the string, said spring being twisted via its joined other end, whereby the windings of said spring are extended, and can freely slide on said bush.

11. A fine-tuning peg as described in claim 1, further comprising a tuning wheel shaft on which said tuning wheel is seated and which is rotatably supported in said peg head, transversely to the longitudinal axis of the tuning shaft.

12. A fine-tuning peg as described in claim 11, wherein said tuning wheel comprises an edge part and said peg head has an orifice in its wall at the outer edge, facing away from the peg box through which orifice said edge part protrudes that said tuning wheel can be turned thereby from the outside.

* * * * *